US008084735B2

(12) United States Patent
Kertesz et al.

(10) Patent No.: US 8,084,735 B2
(45) Date of Patent: Dec. 27, 2011

(54) PULSED VOLTAGE ELECTROSPRAY ION SOURCE AND METHOD FOR PREVENTING ANALYTE ELECTROLYSIS

(75) Inventors: Vilmos Kertesz, Knoxville, TN (US); Gary Van Berkel, Clinton, TN (US)

(73) Assignee: UT-Battelle, LLC, Oak Ridge, TN (US)

( * ) Notice: Subject to any disclaimer, the term of this patent is extended or adjusted under 35 U.S.C. 154(b) by 240 days.

(21) Appl. No.: 12/431,461

(22) Filed: Apr. 28, 2009

(65) Prior Publication Data

US 2010/0072394 A1 Mar. 25, 2010

Related U.S. Application Data

(63) Continuation-in-part of application No. 12/237,892, filed on Sep. 25, 2008.

(51) Int. Cl.
*B05B 5/03* (2006.01)
*H01J 49/00* (2006.01)

(52) U.S. Cl. ..... 250/288; 250/281; 250/282

(58) Field of Classification Search ..... 250/281, 250/282, 288

See application file for complete search history.

(56) References Cited

U.S. PATENT DOCUMENTS

| | | | | |
|---|---|---|---|---|
| 4,842,701 | A * | 6/1989 | Smith et al. | 204/451 |
| 4,885,076 | A * | 12/1989 | Smith et al. | 204/451 |
| 5,349,186 | A * | 9/1994 | Ikonomou et al. | 250/288 |
| 6,107,626 | A * | 8/2000 | Wang et al. | 250/288 |
| 6,127,680 | A * | 10/2000 | Andrien et al. | 250/288 |
| 6,452,166 | B1 * | 9/2002 | Enke et al. | 250/288 |
| 6,586,731 | B1 * | 7/2003 | Jolliffe | 250/288 |
| 6,627,883 | B2 * | 9/2003 | Wang et al. | 250/292 |
| 6,690,006 | B2 * | 2/2004 | Valaskovic | 250/288 |
| 6,723,985 | B2 * | 4/2004 | Schultz et al. | 250/288 |
| 6,737,640 | B2 * | 5/2004 | Kato | 250/281 |
| 6,744,046 | B2 * | 6/2004 | Valaskovic et al. | 250/288 |
| 6,768,107 | B2 * | 7/2004 | Schultz et al. | 250/288 |

(Continued)

FOREIGN PATENT DOCUMENTS

WO WO2007/056122 6/2007

OTHER PUBLICATIONS

Kertesz, V. et al., Using the Inherent Electrochemistry in a Microfabricated Nanospray Emitter System for Analytical Advantage (2006 Poster).

(Continued)

*Primary Examiner* — David A Vanore
(74) *Attorney, Agent, or Firm* — Novak Druce + Quigg

(57) ABSTRACT

An electrospray ion source and method of operation includes the application of pulsed voltage to prevent electrolysis of analytes with a low electrochemical potential. The electrospray ion source can include an emitter, a counter electrode, and a power supply. The emitter can include a liquid conduit, a primary working electrode having a liquid contacting surface, and a spray tip, where the liquid conduit and the working electrode are in liquid communication. The counter electrode can be proximate to, but separated from, the spray tip. The power system can supply voltage to the working electrode in the form of a pulse wave, where the pulse wave oscillates between at least an energized voltage and a relaxation voltage. The relaxation duration of the relaxation voltage can range from 1 millisecond to 35 milliseconds. The pulse duration of the energized voltage can be less than 1 millisecond and the frequency of the pulse wave can range from 30 to 800 Hz.

19 Claims, 9 Drawing Sheets

U.S. PATENT DOCUMENTS

| | | | | |
|---|---|---|---|---|
| 6,795,293 | B2 | 9/2004 | Timonov et al. | |
| 6,809,316 | B2 * | 10/2004 | Kato | 250/288 |
| 6,903,334 | B1 * | 6/2005 | Makarov et al. | 250/288 |
| 7,060,975 | B2 * | 6/2006 | Seaward et al. | 250/288 |
| 7,075,066 | B2 * | 7/2006 | Bailey et al. | 250/288 |
| 7,122,791 | B2 * | 10/2006 | Joyce et al. | 250/288 |
| 7,141,807 | B2 * | 11/2006 | Joyce et al. | 250/492.1 |
| 7,173,240 | B2 * | 2/2007 | Seaward et al. | 250/288 |
| 7,186,974 | B2 * | 3/2007 | Tojo | 250/288 |
| 7,335,897 | B2 * | 2/2008 | Takats et al. | 250/425 |
| 7,368,708 | B2 | 5/2008 | Fischer | |
| 7,671,344 | B2 * | 3/2010 | Tang et al. | 250/423 R |
| 7,816,646 | B1 * | 10/2010 | Willoughby et al. | 250/288 |
| 7,829,847 | B2 * | 11/2010 | Chiarot et al. | 250/288 |
| 7,858,932 | B2 * | 12/2010 | Finch et al. | 250/288 |
| 7,872,225 | B2 * | 1/2011 | Whitehouse et al. | 250/288 |
| 2003/0183757 | A1 * | 10/2003 | Kato | 250/281 |
| 2010/0072357 | A1 * | 3/2010 | Kertesz et al. | 250/281 |

OTHER PUBLICATIONS

Lu, Y. et al., Pulsed Electrospray for Mass Spectrometry, Anal. Chem., 73, 4748-4753 (2001).

Markides et al., Mass spectrometry (MS) and nuclear magnetic resonance (NMR) applied to biological macromolecules, Advanced information on the Nobel Prize in Chemistry, 1-13 (2002).

Van Berkel, G.J. et at., Electrochemistry Spray Ion Source, Anal. Chem., 5511-5520 (Aug. 1, 2007).

Yeo, L.Y. et al., A New AC Electrospray Mechanism by Maxwell-Wagner Polarization and Capillary Resonance, University of Notre Dame, Notre Dame, IN, USA, 1-4 (2004).

Lastochkin et al., A high-frequency electrospray driven by gas volume charges, Abstract, J. Appl. Phys. 97, 123309 (Jun. 27, 2005).

Yeo et al., High frequency AC electrosprays: mechanisms and applications, Abstract, Transactions of Wessex Institute, http://library.witpress.com/pages/paperinfo.asp?PaperID=15979, printed Apr. 4, 2009.

Kessick et al., The use of AC potentials in electrospraying and electrospinning processes, Abstract, Polymer, vol. 45, issue 9, pp. 2981-2984 (Apr. 2004).

Yeo et al., AC electrospray biomaterials synthesis, Abstract, Biomaterials, vol. 26, issue 31, pp. 6122-6128 (Nov. 2005).

Lozano P et al: "Ionic liquid ion sources: suppression of electrochemical reactions using voltage allernation" Journal of Colloid and Interface Science, Academic Press, New York, NY, US LNKDOI: 10.1016/J.JCIS.2004.07.037, vol. 280, No. 1, Dec. 1, 2004, pp. 149-154, Figure 2.

Kertesz V et al: "Expanded Use of a Battery-Powered Two-Electrode Emitter Cell for Electrospray Mass Spectrometry" Journal of the American Society for Mass Spectrometry, Elsevier Science Inc, US LNKD-DOI:10.1016/J.JASMS.2006.02.007, vol. 17, No. 7, Jul. 1, 2006, pp. 953-961, Abstract, Figures 1, 2, 4.

Chao Bing-Fong et al: "Sheathless capillary electrophoresis-mass spectrometry using a pulsed electrospray ionization source" Electrophoresis, vol. 27, No. 11, Sp. Iss. SI. Jun. 2006, pp. 2083-2090, XP007914084 ISSN: 0173-0835, p. 2085-p. 2086; figures 1, 2.

* cited by examiner

PULSED VOLTAGE ELECTROSPRAY ION SOURCE AND METHOD FOR PREVENTING ANALYTE ELECTROLYSIS

CROSS REFERENCE TO RELATED APPLICATIONS

This application is a continuation-in-part of U.S. patent application Ser. No. 12/237,892, entitled "Electrospray Ion Source with Reduced Analyte Electrolysis," filed Sep. 25, 2008, the entirety of which is incorporated herein by reference.

STATEMENT REGARDING FEDERALLY SPONSORED RESEARCH OR DEVELOPMENT

This invention was made with government support under contract no. DE-AC05-00OR22725 awarded by the U.S. Department of Energy. The Government has certain rights in the invention.

FIELD OF THE INVENTION

The present invention relates to an electrospray ionization source and methods of using the same.

BACKGROUND OF THE INVENTION

Electrospray ionization (ESI) sources are used to produce gas phase analyte ions for analysis by analytical instruments, such as mass spectrometers. Under common electrospray ionization mass spectrometry (ESI-MS) conditions most analytes are not directly affected by the electrochemical process occurring while passing through the ESI source. Nonetheless, electrochemical reactions of analytes of interest can and do take place. These electrochemical reactions can alter the analyte molecules such that the ions observed in the gas phase have a different mass, charge, or both, from the original analyte molecule. Planned analyte electrolysis can be very advantageous, providing the ability to create novel gas-phase ionic species, probe analyte redox chemistry, and perform electrochemical ionization.

In general, problems with ESI source analyte electrolysis arise where the analyte has a low oxidation potential or high reduction potential relative to the surface potential generated at the electrode surface in order to produce the current required for ionization. As used herein, the phrase "low oxidation potential or high reduction potential" is used to refer to the problem of electrolysis of low oxidation potential analytes in positive ion mode ESI and the problem of electrolysis of high reduction potential analytes in negative ion mode ESI. Several reports propose to eliminate this effect using homogeneous redox buffer solutions or sacrificial electrode materials to buffer the potential of the emitter to a degree where analyte electrolysis does not take place. Unfortunately, both methods introduce products of the buffering reaction to the solution that may have unwanted effects. For example, the hydroquinone oxidation product benzoquinone can react with thiol moieties in an analyte solution resulting in an unintended mass shift in the mass spectrum, and oxidation of a sacrificial metal electrode introduces metal ions in the solution that may act as complexing agents thereby changing the characteristics of the mass spectrum.

SUMMARY OF THE INVENTION

In one embodiment, the invention is drawn to an electrospray ion source, comprising, an emitter, a counter-electrode and a power supply. The emitter can include a liquid conduit, a primary working electrode having a liquid contacting surface, and a spray tip. The liquid conduit and the working electrode can be in liquid communication. The counter electrode can be proximate to, but separated from, the spray tip. The power system can be designed and connected for supplying voltage to the working electrode in the form of a pulse wave.

The pulse wave can oscillate between at least an energized voltage and a relaxation voltage. The duration of the relaxation voltage can range from 1 millisecond to 35 milliseconds or from 1 millisecond to 10 milliseconds. The pulse duration of the energized voltage can be less than 300 microseconds or less than 200 microseconds. The frequency of the pulse wave can range from 30 to 800 Hz, or from 50 to 300 Hz.

The electrospray ion source can also include a means for inputting an analyte solution parameter to the power supply, where the power supply assigns a parameter of the pulse wave based on the analyte solution parameter. The analyte solution parameter can be a double layer relaxation time of a solvent in an analyte solution, and the power supply can assign the duration based on the double layer relaxation time. The processor can assign the duration such that the duration is greater than or equal to the double layer relaxation time.

The relaxation voltage can be approximately 0 volts. The relaxation voltage can be of the same polarity as the energized voltage.

The electrospray ion source can include multiple working electrodes that have multiple liquid contacting surfaces in liquid communication with the liquid conduit. The power system can supply voltage to these multiple working electrodes in the form of multiple pulse waves. The pulse waves can oscillate between energized voltages and relaxation voltages that can be the same or different, and the duration of each relaxation voltage can range from 1 millisecond to 35 milliseconds.

The electrospray ion source can also include a sensor in electrical communication with the power system. The sensor can be designed and positioned to detect a parameter related to an electric potential experienced by an analyte conveyed through the emitter. The parameter related to an electric potential experienced by an analyte conveyed through the emitter can be selected from the group consisting of surface potential of the working electrode, electrical potential of a double layer proximate the working electrode, electrical potential outside of the double layer, and combinations thereof.

In another embodiment, the invention is drawn to a method of ionizing an analyte of interest. The method includes conveying an analyte solution comprising an analyte of interest through an electrospray ion source, where the electrospray ion source has a working electrode with a liquid contacting surface in contact with the analyte solution. The method can further require supplying voltage in the form of a pulse wave to the working electrode. The pulse wave can oscillate between an energized voltage and a relaxation voltage, where a duration of the relaxation voltage ranges from 1 millisecond to 35 milliseconds and a frequency of the pulse wave ranges from 30-800 Hz. The method can cause net excess ions of either positive polarity (positive ion mode) or negative polarity (negative ion mode) to be emitted from the electrospray ion source while the voltage in the form of a pulse wave is supplied.

The method can include inputting an analyte solution parameter into a power supply associated with the electrospray ion source, and assigning a parameter of the pulse wave based on the analyte solution parameter. The analyte solution parameter can be the double layer relaxation time, and the relaxation duration can be assigned such that the relaxation duration is greater than or equal to the double layer relaxation time. The method can also include detecting an analyte value related to an electric potential experienced by an analyte conveyed through said emitter, and adjusting a parameter of the pulse wave based on the analyte value.

These and other embodiments are described in more detail below.

BRIEF DESCRIPTION OF THE DRAWINGS

A fuller understanding of the present invention and the features and benefits thereof will be obtained upon review of the following detailed description together with the accompanying drawings, in which.

DETAILED DESCRIPTION

This invention is drawn to an electrospray ion source emitter that prevents the analyte of interest in an analyte solution from undergoing an electrolysis reaction. The inventive electrospray ion source allows more accurate analytical measurements of analytes, particularly low oxidation potential analytes and high reduction potential analytes. The invention is also drawn to a method of producing gas phase ions of an analyte of interest while preventing electrochemical reactions of the analyte of interest. As used herein, is it to be understood that the phrase "low oxidation potential or high reduction potential" is used to refer to the problem of electrolysis of low oxidation potential analytes in positive ion mode ESI and the problem of electrolysis of high reduction potential analytes in negative ion mode ESI.

Figure 1:
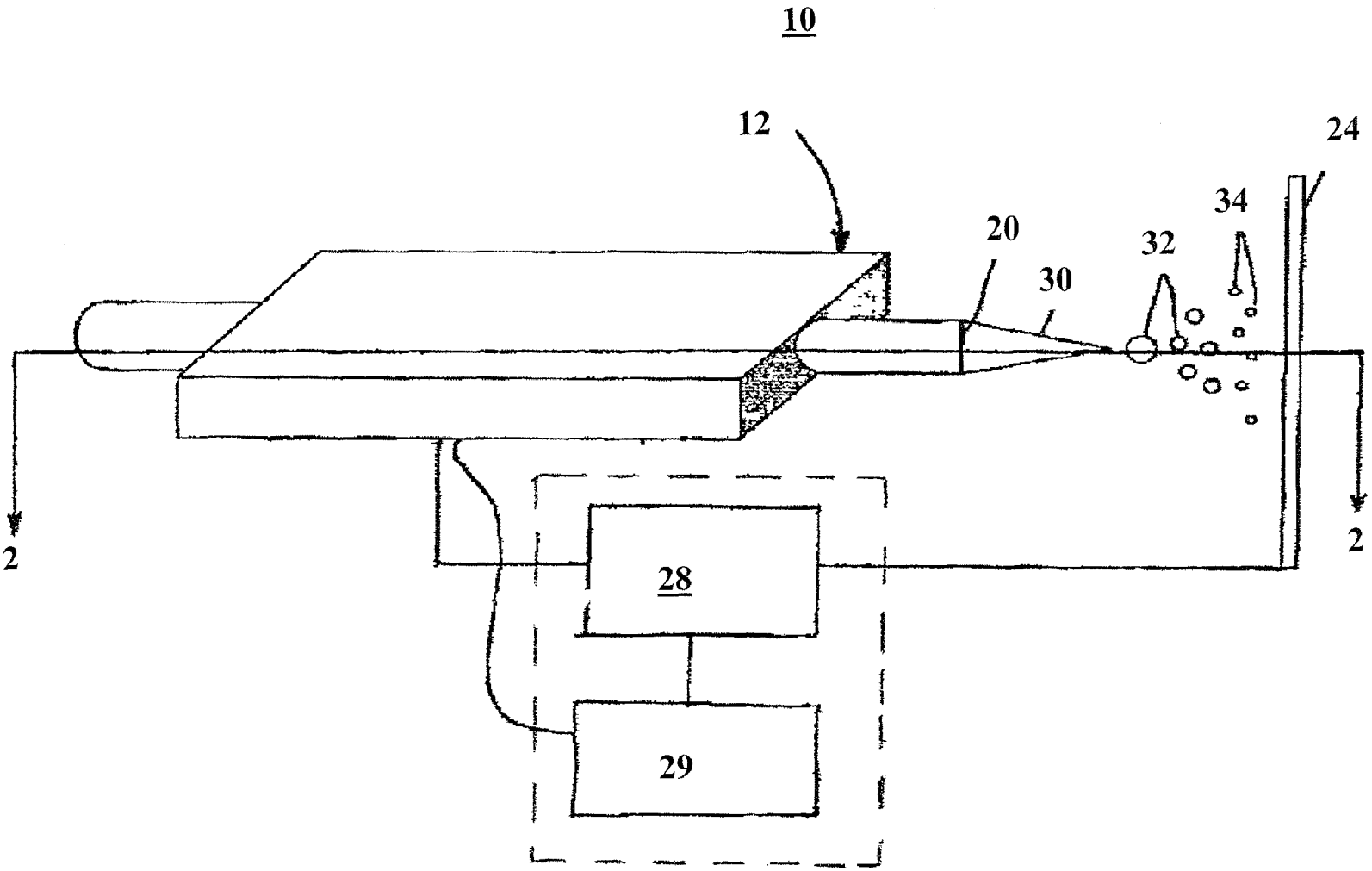
FIG. 1 is a drawing of an electrospray ion source according to the invention.
Figure 2:
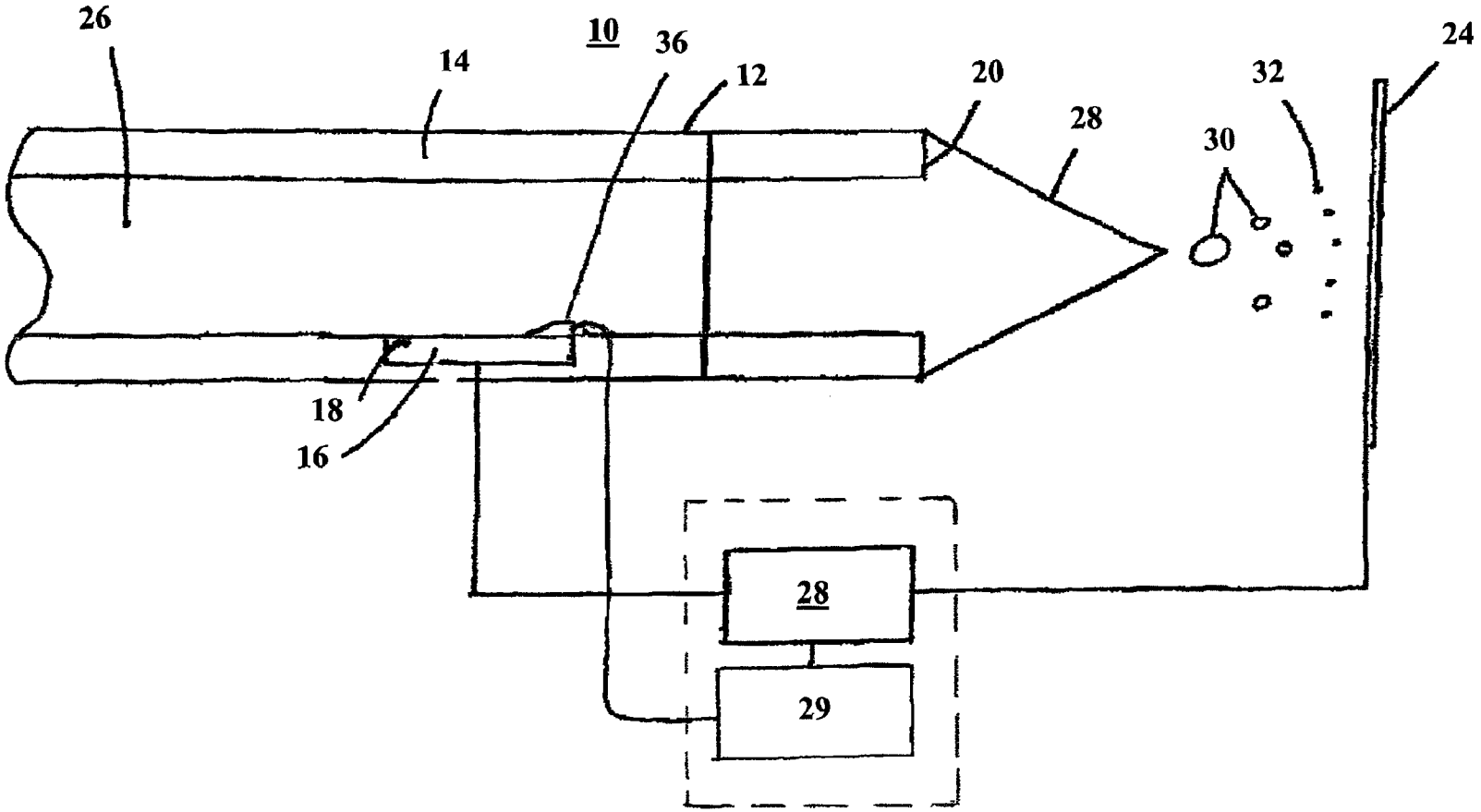
FIG. 2 is a cross-section of the electrospray ion source of FIG. 1 taken along cut line 2-2.

As shown in FIGS. 1 and 2, the electrospray ion (ESI) source 10 can include an emitter 12 that includes a liquid conduit 14, a primary working electrode 16 having a liquid contacting surface 18, and a spray tip 20. The liquid conduit 14 and the working electrode 16 can be in liquid communication. The ESI source can also include a counter electrode 24 proximate to, but separated from, the spray tip 20. A power system 28 for supplying voltage in the form of a pulse wave to the working electrode 16 can be included in the ESI source 10.

The primary working electrode 16, and the MS front plate, or counter electrode 24, can be attached to the same power system 28. As used herein, the power system 28 can include one or more power sources for supplying voltage to the primary working electrode 16, the counter electrode 24, and any other electrodes associated with the ESI source requiring a voltage supply. The power system 28 can be designed to apply voltage to the primary working electrode 16 and a second working electrode (not shown), independently. Whether the power system 28 employs multiple power sources or not, the power system 28 can be controlled by a processor 29 capable of controlling and coordinating the voltage pulses described herein. The function of the processor 29 can be performed by one or more processors, logic circuits, or similar devices.

The processor 29 can be part of a computer and, as shown by the dotted box in FIGS. 1 and 2, can be included as part of the power system 28. Accordingly, it should be understood that the phrase power system 28 can be used to refer to a multiplicity of separate or integrated components providing the described functionality. Exemplary components of a power system 28 include, but are not limited to, a high voltage power supply, a high voltage pulse generator, a transistor-transistor logic (TTL) pulse generator and a processor 29.

The voltage supplied by the power system 28 can be controlled by an isolated potentiostat-isolation transformer arrangement. Such a power supply arrangement is disclosed in Gary J. Van Berkel and Kertesz, V., "Using the Electrolysis of the Electrospray ion Source," Analytical Chemistry, p. 5510-5520 (Aug. 1, 2007), the entirety of which is incorporated herein by reference.

The exact mechanism of analyte ion formation is not critical to practicing the invention, and the following explanation of the formation of the individual analyte ions 34 is not intended to be binding. The liquid 26 exiting the spray tip 20 can contain a net excess of positive ions or negative ions, in positive ion mode or negative ion mode, respectively. The net excess of ions can form a Taylor cone 30 before separating into analyte ion containing droplets 32 due, in part, to the charge accumulation in the liquid 26. The droplets 32 continue to subdivide until the liquid portion evaporates leaving individual gas-phase analyte ions 34. These gas-phase analyte ions 34 can then be analyzed using an analytical instrument (not shown), such as a mass spectrometer. The voltage applied to the working electrode 16 can be sufficient to supply gas-phase analyte ions for evaluation by a downstream analytical device, such as a mass spectrometer.

As used herein, the term "liquid conduit" is used to describe any conduit used for conveying liquid upstream of the spray tip. The liquid conduit can be any shape including, but not limited to, tubular, hexahedral, e.g., regular hexahedral, cuboid, etc., or a combination thereof. The liquid conduit can have a constant cross-sectional shape. However, it should be noted that, as shown in FIG. 1, it is not critical that the shape of the liquid conduit be constant along its length.

Figure 3:
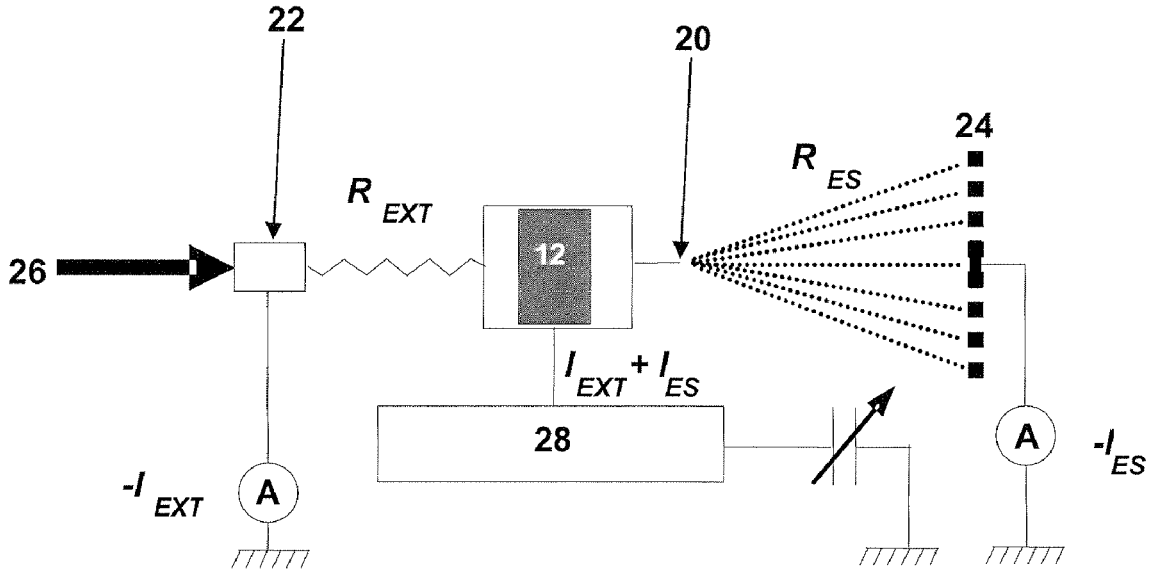
FIG. 3 is an electrical schematic of an electrical circuit of an exemplary single-electrode, pulsed voltage electrospray ion source according to the invention.

FIG. 3 depicts an electrical schematic of an electrical circuit of an exemplary single-electrode, pulsed voltage electrospray ion source according to the invention. The schematic shows (i) the external current loop with resistance $R_{EXT}$, resulting in current $I_{EXT}$, between the upstream grounding point 22 and the emitter 12, and (ii) the downstream electrospray circuit with resistance $R_{ES}$, resulting in current $I_{ES}$, between the emitter 12 and the counter electrode 24, which serves as the downstream ground.

Figure 4:
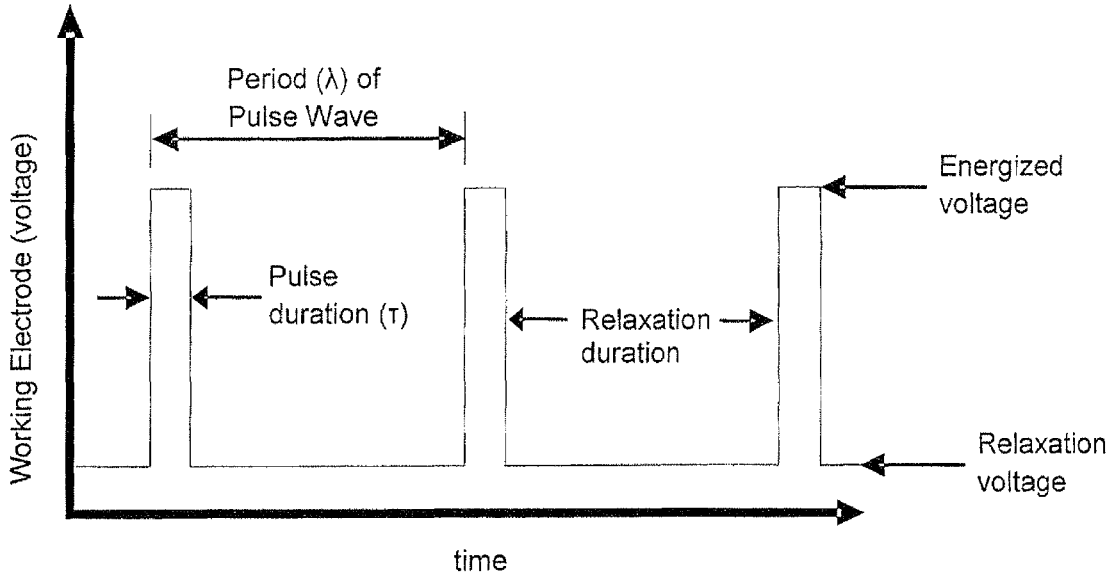
FIG. 4 is a graph showing a periodic, non-sinusoidal pulse wave of voltage according to the invention.

As shown in FIG. 4, the pulse wave can oscillate between at least an energized voltage and a relaxation voltage. As used herein, the term "pulse wave" is used to describe a periodic, non-sinusoidal function that maintains the first voltage, e.g., an energized voltage, for the pulse duration, then switches rapidly to a second voltage, e.g., a relaxation voltage, which is maintained for the relaxation duration. In general, a pulse wave will approximate a step or rectangular function. However, it is to be understood that deviations from a step or rectangular function are encompassed by the term pulse wave as long as the function maintains the first voltage for the pulse duration, then switches rapidly to a second voltage, which is maintained for the relaxation duration. Finally, although a pulse wave generally varies between two constant voltages, the pulse wave can vary between more than two constant voltages as long as the pulse wave maintains the first voltage for the pulse duration, then switches rapidly to a second voltage which is maintained for the relaxation duration.

The method and device disclosed herein prevent electrolysis of analytes of interest while producing a continuous gas-phase ion stream from the spray tip of an ESI emitter. Although not necessary to practice the invention and not intended to be binding, it is believed that because the short voltage pulses delivered by the working electrode inject a finite amount of charge into the analyte solution, the charge is consumed prior to analytes of interest contacting the liquid contacting surface. This appears to be due to double layer effects at the liquid contacting surface of the working electrode. It is believed that the pulse duration is too short for the double layer to reach equilibrium and cause electrochemical reactions with the analyte of interest. Finally, the relaxation duration is long enough that the charge accumulated in the double layer as a result of the pulse dissipates before the subsequent pulse is applied. The pulse wave supplied to the working electrode, or working electrodes, can be described using a variety of pulse wave parameters that include, but are not limited to relaxation voltage, energized voltage, relaxation duration, pulse duration, frequency, and duty cycle, i.e., the pulse duration divided by the cycle time. In general, pulse wave parameters can be selected in order to prevent analyte diffusion to the surface of the working electrode(s) and allow relaxation of the double layer between pulses.

The relaxation duration of the relaxation voltage can range from 1 millisecond to 35 milliseconds. The relaxation duration, during which the relaxation voltage is applied in each cycle, can range from 1 millisecond to 20 milliseconds, or from 1 millisecond to 10 milliseconds, or from 1 millisecond to 8 milliseconds, or from 1 millisecond to 6 milliseconds. The relaxation duration of the relaxation voltage can be at least 2 milliseconds, or at least 3 milliseconds, or at least 5 milliseconds. The relaxation duration can be any combination of the ranges disclosed above, such as between 5 and 20 milliseconds, or between 2 and 8 milliseconds.

As used herein, the energized voltage pulse duration must be a positive value, e.g., at least 1 attosecond, 1 picosecond, 1 microsecond. The pulse duration can be less than 300 microseconds, less than 200 microseconds, or less than 150 microseconds. The pulse duration can be at least 50 nanoseconds, at least 500 nanoseconds, at least 1 microsecond, at least 10 microseconds, or at least 50 microseconds. The pulse duration can be any combination of the ranges disclosed above, for example 1 picosecond to 200 microseconds, or 50 microseconds to 150 microseconds.

The frequency of the pulse wave can be less than 800 Hz, less than 500 Hz, less than 300 Hz, or less than 250 Hz. The frequency of the pulse wave can be at least 30 Hz, at least 50 Hz, or at least 75 Hz. The frequency can be any combination of these, such ranging from 75 to 250 Hz or ranging from 20 to 500 Hz.

It has been unexpectedly discovered that by applying pulse waves as disclosed herein, it is possible to produce a continuous flow of gas-phase analyte ions without inducing electrolysis of low oxidation potential analytes or high reduction potential analytes. For example, continuous net excess of positive ions or negative ions can be produced in positive ion mode and negative ion mode, respectively. A Taylor cone can be formed while the pulse wave voltage is applied to the electrode or electrodes. At the same time, the mass spectra data demonstrates that the gas-phase analyte ions are not oxidized using the pulsed ESI device and technique disclosed herein. Using the pulsed ESI device and method disclosed herein, less than 50% of an analyte with a low oxidation potential or a high reduction potential undergo electrochemical reactions as a result of the ESI process. The percentage of low oxidation potential or high reduction potential analytes undergoing electrochemical reactions as a result of the ESI process can be less than 40%, less than 30%, less than 20% or less than 10%. Low oxidation potential analytes or high reduction potential analytes are those that undergo electrolysis reactions when exposed to standard voltage sources used in ESI sources, which, for example, continuously apply voltages of at least positive or negative 1 kV, or 2 kV, or 5 kV, respectively.

The electrospray ion source can include a means for inputting an analyte solution parameter to said power supply. The power supply can assign a parameter of the pulse wave based on the analyte solution parameter. Exemplary analyte solution parameters include, but are not limited to, the oxidation or reduction potential of the analyte, the double layer relaxation time of the solvent or co-solvent in the analyte solution. The means for inputting analyte solution parameters include manual entry, cross-referencing data entered manually with a remote or local data base, detection with a sensor, or any other means known to those of skill in the art.

The analyte solution parameter can be the double layer relaxation time of a solvent in the analyte solution, and the power supply can assign a relaxation duration based on the double layer relaxation time. The relaxation duration can be assigned a value that is greater than or equal to the double layer relaxation time.

The relaxation voltage can be of the same polarity as the energized voltage. The relaxation voltage can be approximately 0 volts. As used herein, "approximately 0 volts" is generally intended to encompass a range of voltage between 0 volts and 20 volts, or between 0 volts and 10 volts, or between 0 volts and 5 volts. However, it is envisioned that approximately 0 volts can include a range of voltages between −20 volts and 20 volts, or between −10 volts and 10 volts, or between −5 volts and 5 volts.

The relaxation voltage can be 500 volts or less, or 250 volts or less, or 100 volts of less. The relaxation voltage can be 0V or greater. The relaxation voltage can be of the same polarity as the energized voltage.

Unexpectedly, the energizing voltage can far exceed the oxidation potential or reduction potential of the analyte of interest without causing electrolysis of the analyte. The energizing voltage can be at least two times, at least five time, at least ten times, or at least twenty times the relevant oxidation or reduction potential of the analyte of interest. For example, the energizing voltage can be at least 3 kV, at least 4 kV, at least 5 kV, or at least 10 kV. Unexpectedly, ESI operation using the pulse wave disclosed herein, enables continuous production of gas-phase ions of the analyte and a continuous net excess of positive ions or negative ions can be produced without causing oxidation or reduction of the analyte of interest.

The ESI source can include at least one secondary electrode, having a secondary liquid contacting surface in liquid communication with said liquid conduit. The power system can supply voltage to the secondary working electrode in the form of a second pulse wave, where the second pulse wave oscillates between at least a second energized voltage and a second relaxation voltage, where the duration of the second relaxation voltage ranges from 1 millisecond to 500 milliseconds. The first and at least one second pulse waves can be staggered such that pulses of the each pulse wave occur during the relaxation duration of the other pulse wave. The first and at least one second pulse waves can be the same or different, though they have the same form as the pulse wave.

This approach of staggering voltage pulses among a number of electrodes can be extended to larger numbers of electrodes. For example, an electrospray emitter can include 50 electrodes, where the power system is programmed so that the high voltage supply is connected to each of the 50 electrodes sequentially for 200 microseconds at a 100 Hz frequency, i.e., 10 milliseconds per cycle. Using this approach, it is possible to deliver a continuous high voltage supply to the analyte solution (50 electrodes×200 microseconds per electrode=10 milliseconds), while providing each electrode with a 9.8 millisecond relaxation time to prevent electrolysis of the analyte of interest. The electrode can be any ESI electrode, including, but not limited to, a porous flow through electrode, a flow by electrode, and a combination thereof.

The electrospray ion source can further comprise a sensor in electrical communication with the power system. The sensor can be adapted for and disposed to detect a parameter related to an electric potential experienced by an analyte conveyed through said emitter. Exemplary parameters related to an electric potential experienced by the analyte include, but are not limited to, surface potential of the working electrode, electrical potential outside of a double layer, double layer relaxation time for the analyte solution, and combinations thereof.

The electrospray ion source can include a calibration step during which the sensor is used to determine one or more parameters related to an electric potential experienced by the analyte. This information can be used to determine a parameter of the pulse wave voltage that will be supplied during ionization of the analyte solution. This feature can be used in combination with the inputting steps described above, in which analyte solution parameters such as the oxidation or reduction potential of the analyte or the double layer relaxation time of the solvent or co-solvent in the analyte solution are entered into the power system.

The features of the inventive electrospray ion source 10 can be incorporated into conventional electrospray ion emitters including, but not limited to, grounded emitters, floated emitters, controlled-potential electrolysis electrospray emitters, either with or without an upstream ground. Several examples can be found in Gary J. Van Berkel and Kertesz, V., "Using the Electrolysis of the Electrospray Ion Source," Analytical Chemistry, p. 5510-5520 (Aug. 1, 2007).

Also disclosed is a method of producing a gas-phase ion of an analyte of interest without causing electrolysis with the analyte of interest. The method can include conveying an analyte solution comprising an analyte of interest through an electrospray ion source, and supplying voltage in the form of a pulse wave to the working electrode. The pulse wave can oscillate between at least an energized voltage and a relaxation voltage, where the duration of the relaxation voltage ranges from 1 millisecond to 35 milliseconds and a frequency of the pulse wave ranging from 30 to 800 Hz. A continuous Taylor cone can be emitted from the electrospray ion source while the voltage in the form of a pulse wave is supplied to the electrode.

The method can also include inputting an analyte solution parameter to a power supply associated with the electrospray ion source, and assigning a parameter of the pulse wave based on the analyte solution parameter. The analyte solution parameter can be a double layer relaxation time, and the duration of the pulse wave can be assigned such that the duration is greater than or equal to the double layer relaxation time.

The method can also include detecting an analyte value related to an electric potential experienced by the analyte conveyed through the emitter, and adjusting a parameter of the pulse wave based on the analyte value. The analyte value can be detected using a sensor disposed in the ion source and in communication with said power system.

In contrast to prior art redox buffering techniques, which introduce chemicals into the solution during their operation that may react the analyte of interest causing an undesirable mass shift and/or signal suppression, the inventive electrospray ion sources generate only excess charge polarity in solution without electrolysis of the analyte of interest. In summary, emitters coated with compounds that generate only excess charge polarity in solution provide a way to eliminate analyte electrolysis.

EXAMPLES

It should be understood that the Examples described below are provided for illustrative purposes only and do not in any way limit the scope of the invention.

In order to evaluate the pulsed voltage concept, a pulsed electrospray ionization system was built and tested. The power system was composed of a transistor-transistor logic (TTL) pulse generator, a high voltage (HV) power supply and ground that were coupled to a high voltage pulse generator (PVX-4140, Directed Energy, Fort Collins, Colo.). Although these components were separate, it is envisioned that the components could be packaged into a single component. The output of the high voltage pulse generator was used to supply pulse waves to a porous flow through carbon electrode of the electrospray emitter.

Figure 5:
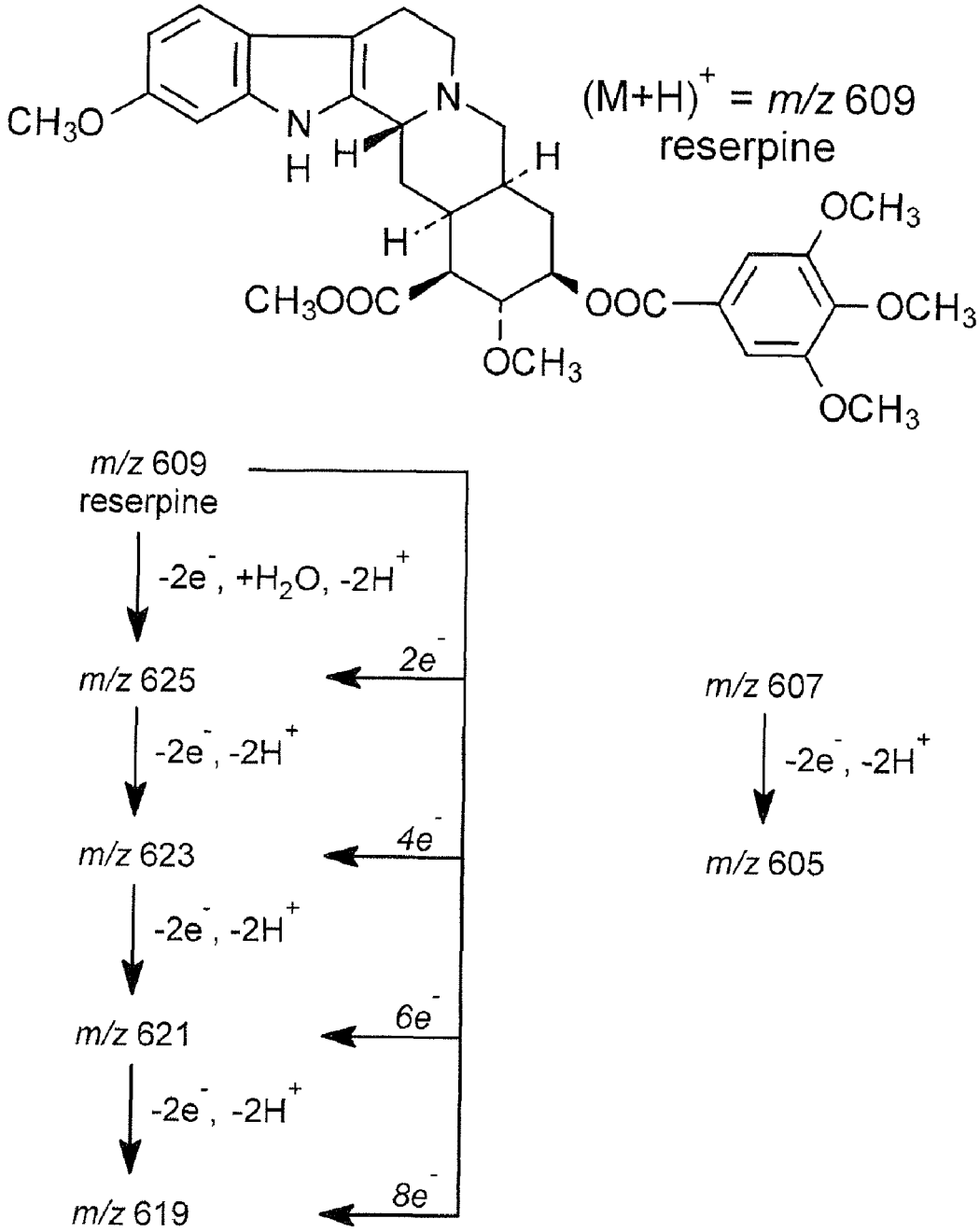
FIG. 5 shows the chemical structure of reserpine and the proposed oxidation pathways and mass-to-charge ratios for the ions observed in positive ion mode.

Mass spectra of reserpine, an oxidation sensitive compound, were then acquired under standard DC conditions and using a variety of different pulse waves. FIG. 5 shows the structure of reserpine and the proposed oxidation pathways and mass to charge ratios for the ions observed in positive ion mode.

Figure 6:
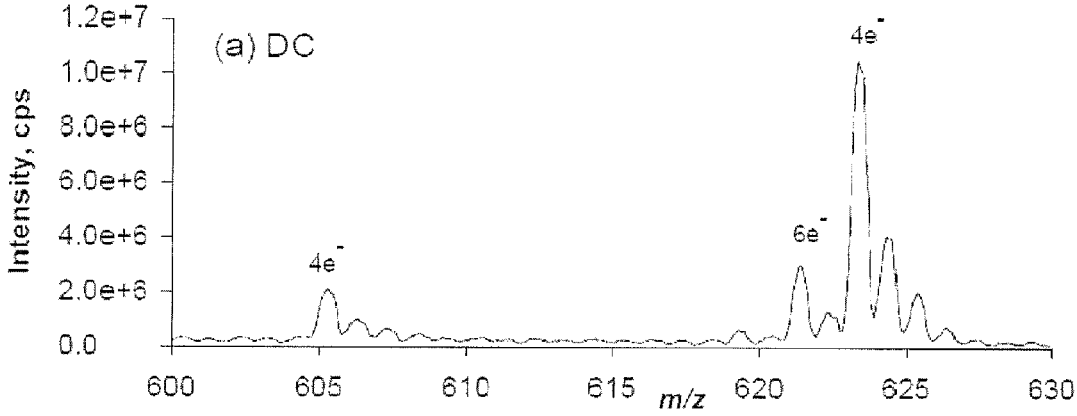
FIGS. 6(*a*) and (*b*) show the mass spectra of reserpine using (a) a conventional DC ESI source, and (b) a pulsed voltage ESI source according to the invention.
Figure 6:
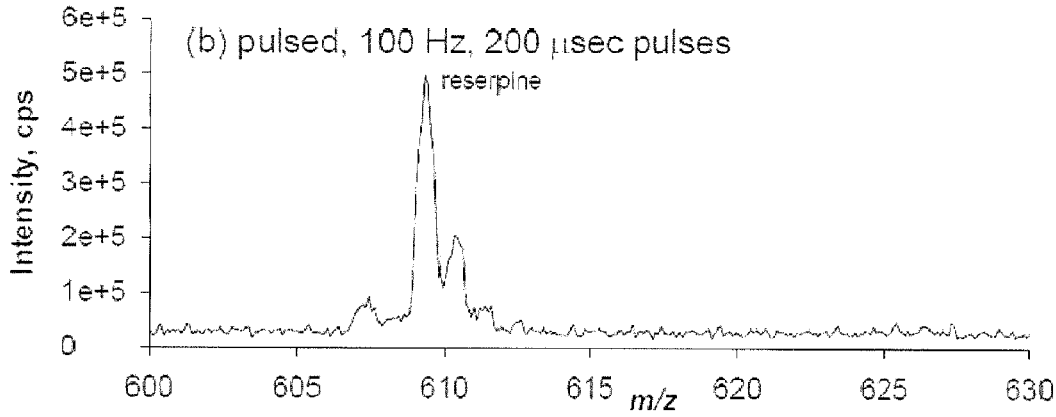

FIG. 6(*a*) shows that the use of DC electrospray causes oxidation of reserpine to its 4-electron (m/z=623 & 605) and 6-electron (m/z=621) oxidation products. In contrast, FIG. 6(*b*) shows that when using a pulse wave with a 5 kV, 200 microsecond pulse at a frequency of 100 Hz, i.e., a 9.8 millisecond relaxation duration, the only peak observed in the mass spectrum is the protonated reserpine molecule (m/z 609). The data in FIGS. 6(*a*) and (*b*) was obtained using identical reserpine samples.

Figure 7:
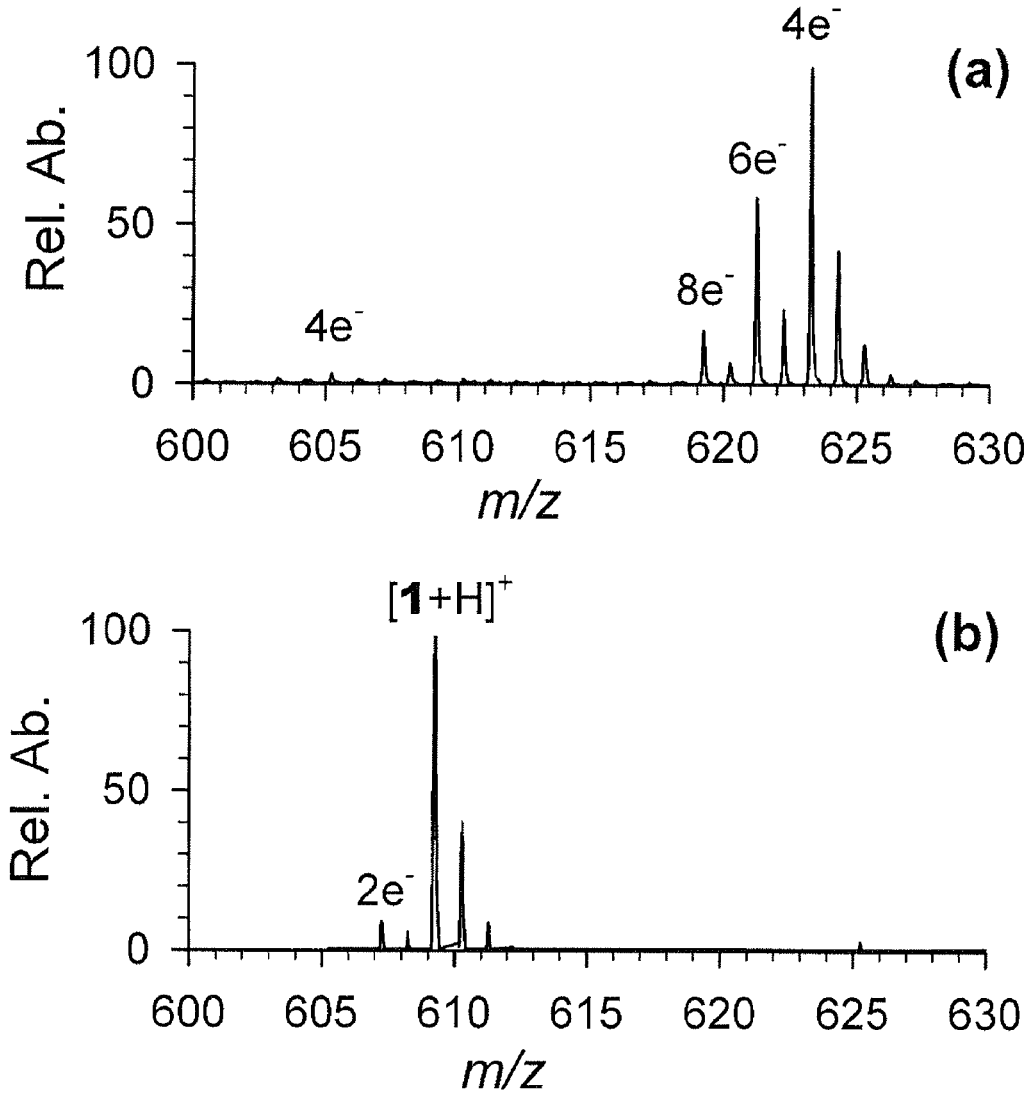
FIGS. 7(*a*) and (*b*) show the mass spectra of a reserpine solution using (a) a conventional DC ESI source, and (b) a pulsed voltage ESI source according to the invention.

Similarly, FIG. 7 shows positive ion mode electrospray mass spectra obtained for a 5 μM solution of reserpine in 50/50/0.75 (v/v/v) water/acetonitrile/acetic acid and 5.0 mM ammonium acetate at a flow rate of 10 μL/min. FIG. 7(*a*) shows the spectra for DC mode operation at 5 kV, while FIG. 7(*b*) shows the spectra for pulse wave operation with 10 microsecond 5 kV pulses applied at 100 Hz, i.e., a 9.99 millisecond relaxation duration. The shift in species detected in the relevant 600 to 630 m/z range clearly demonstrates that the pulsed method prevent oxidation of the reserpine in the analyte solution.

As part of a related experiment, the relative abundances of reserpine and its oxidation products were measured as a function of pulse length and frequency. This data is depicted in FIGS. 8-9.

Figure 8:
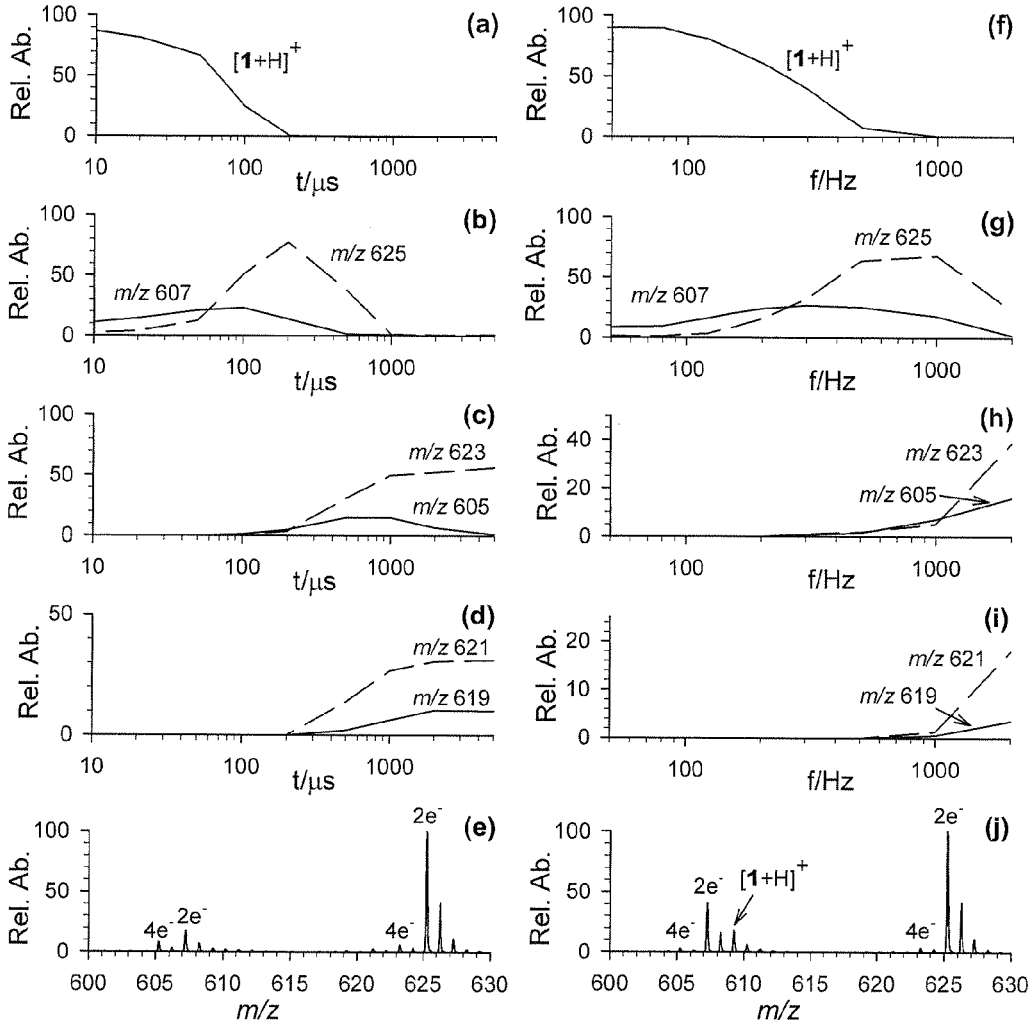
FIGS. 8(*a*)-(*j*) show graphs of the relative abundance of reserpine and its oxidation products versus pulse duration and frequency, and mass spectra showing the effect of various pulse wave parameters on oxidation of reserpine for a 5 μM solution of reserpine.

The data shown in FIGS. 8(*a*)-(*j*) was collected using 5 μM solutions of reserpine in 50/50/0.75 (v/v/v) water/acetonitrile/acetic acid and 5.0 mM ammonium acetate sprayed at a flow rate of 10 μL/min using a porous flow through carbon electrode. FIGS. 8(*a*)-(*d*) show the relative abundance of reserpine and its oxidation products as a function pulse length using 5 kV pulses as a 100 Hz frequency. FIG. 8(*a*) shows the relative abundance of reserpine (m/z 609); FIG. 8(*b*) shows the relative abundance of reserpine's 2 $e^-$ oxidation products (m/z 607 and m/z 625); FIG. 8(*c*) shows the relative abundance of reserpine's 4 $e^-$ oxidation products (m/z 605 and m/z 623); and FIG. 8(*d*) shows the relative abundance of reserpine's 6 $e^-$ (m/z 621) and 8 $e^-$ (m/z 619) oxidation products. FIG. 8(*e*) shows the positive ion mode electrospray mass spectrum of reserpine obtained using pulsed electrospray with ionspray voltage of 5 kV with 100 Hz frequency and 200 microsecond-long pulses.

FIGS. 8(*f*)-(*i*) show the relative abundance of reserpine and its oxidation products as a function of frequency using 50 microsecond long 5 kV pulses. FIG. 8(*f*) shows the relative abundance of reserpine (m/z 609); FIG. 8(*g*) shows the relative abundance of reserpine's 2 $e^-$ oxidation products (m/z 607 and m/z 625); FIG. 8(*h*) shows the relative abundance of reserpine's 4 $e^-$ oxidation products (m/z 605 and m/z 623); and FIG. 8(*i*) shows the relative abundance of reserpine's 6 $e^-$ (m/z 621) and 8 $e^-$ (m/z 619) oxidation products. In addition, FIG. 8(*j*) shows the positive ion mode electrospray mass spectrum of reserpine obtained using pulsed electrospray with 50 microseconds long, 5 kV at a frequency of 500 Hz frequency.

Figure 9:
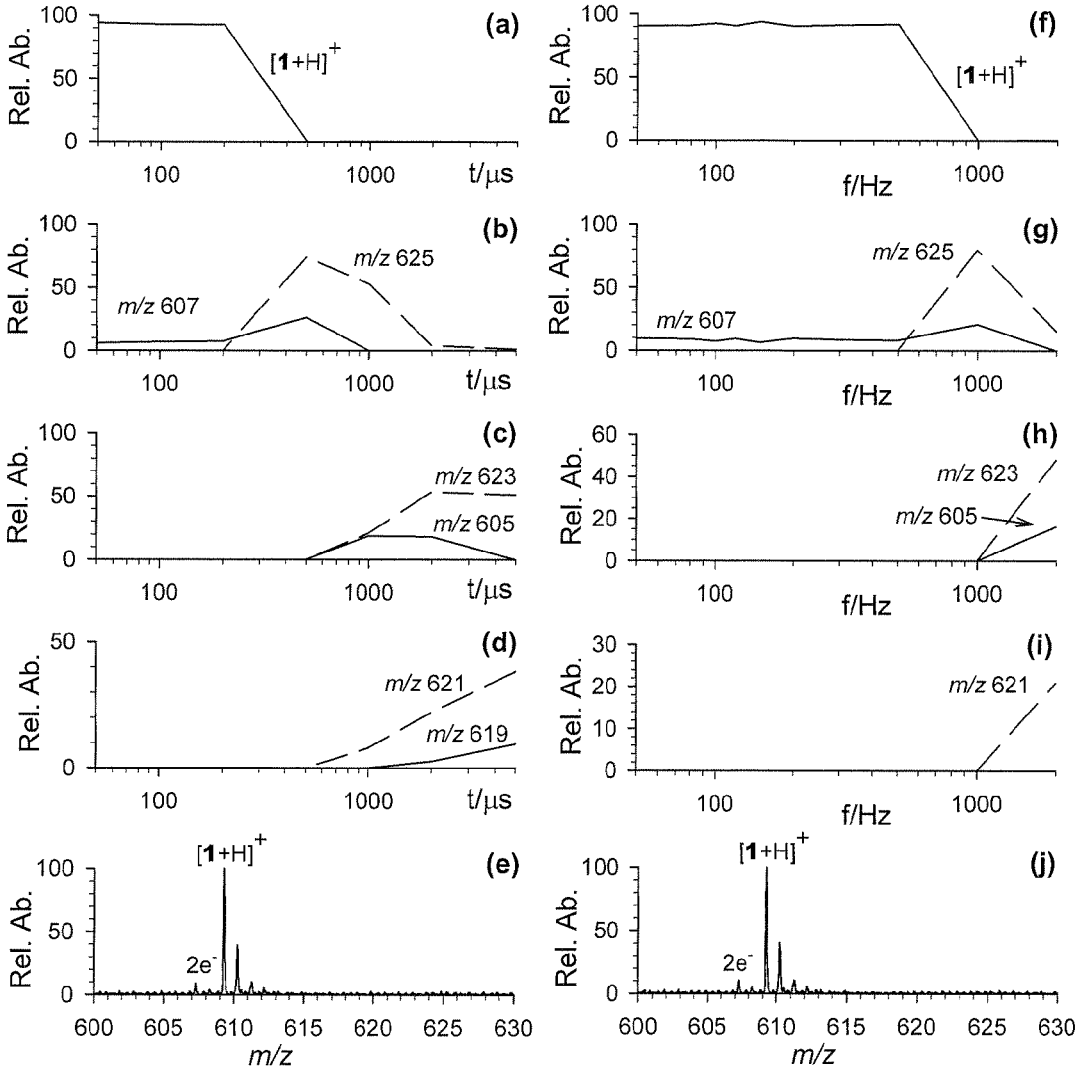
FIGS. 9(*a*)-(*j*) show graphs of the relative abundance of reserpine and its oxidation products versus pulse duration and frequency, and mass spectra showing the effect of various pulse wave parameters on oxidation of reserpine for a 0.2 μM solution of reserpine.

The data shown in FIGS. 9(*a*)-(*j*) was gathered using 0.2 μM solutions of reserpine in 50/50/0.75 (v/v/v) water/acetonitrile/acetic acid and 5.0 mM ammonium acetate sprayed at a flow rate of 10 μL/min using a porous flow through carbon electrode. FIGS. 9(*a*)-(*d*) show the relative abundance of reserpine and its oxidation products as a function pulse length using 5 kV pulses as a 100 Hz frequency. FIG. 9(*a*) shows the relative abundance of reserpine (m/z 609); FIG. 9(*b*) shows the relative abundance of reserpine's 2 $e^-$ oxidation products (m/z 607 and m/z 625); FIG. 9(*c*) shows the relative abundance of reserpine's 4 $e^-$ oxidation products (m/z 605 and m/z 623); and FIG. 9(*d*) shows the relative abundance of reserpine's 6 $e^-$ (m/z 621) and 8 $e^-$ (m/z 619) oxidation products. FIG. 9(*e*) shows the positive ion mode electrospray mass spectrum of reserpine obtained using pulsed electrospray ionization using 200 microsecond long 5 kV pulses at a frequency of 100 Hz.

FIGS. 9(*f*)-(*i*) show the relative abundance of reserpine and its oxidation products as a function of frequency using 50 microsecond long 5 kV pulses. FIG. 9(*f*) shows the relative abundance of reserpine (m/z 609); FIG. 9(*g*) shows the relative abundance of reserpine's 2 $e^-$ oxidation products (m/z 607 and m/z 625); FIG. 9(*h*) shows the relative abundance of reserpine's 4 $e^-$ oxidation products (m/z 605 and m/z 623); and FIG. 9(*i*) shows the relative abundance of reserpine's 6 $e^-$ (m/z 621) and 8 $e^-$ (m/z 619) oxidation products. FIG. 9(*j*) shows the positive ion mode electrospray mass spectrum of reserpine obtained using pulsed electrospray ionization using 50 microsecond long 5 kV pulses at a frequency of 500 Hz.

It is to be understood that while the invention in has been described in conjunction with the preferred specific embodiments thereof, that the foregoing description as well as the examples which follow are intended to illustrate and not limit the scope of the invention. Other aspects, advantages and modifications within the scope of the invention will be apparent to those skilled in the art to which the invention pertains.

We claim:

1. An electrospray ion source, comprising:

an emitter comprising, a liquid conduit, a primary working electrode having a liquid contacting surface, and a spray tip, wherein said liquid conduit and said working electrode are in liquid communication;

a counter electrode proximate to, but separated from, said spray tip;

a power system for supplying voltage to the working electrode in the form of a pulse wave, said pulse wave oscillating between at least an energized voltage and a relaxation voltage, wherein a relaxation duration of said relaxation voltage ranges from 1 millisecond to 35 milliseconds; and means for inputting an analyte solution parameter to said power supply, wherein said power supply assigns a parameter of said pulse wave based on said analyte solution parameter.

2. The electrospray ion source of claim 1, wherein said relaxation duration ranges from 1 millisecond to 10 milliseconds.

3. The electrospray ion source of claim 1, wherein a pulse duration of said energized voltage is less than 300 microsecoonds.

4. The electrospray ion source of claim 1, wherein a pulse duration of said energized voltage is less than 200 microseconds.

5. The electrospray ion source of claim 1, wherein a frequency of said pulse wave ranges from 30 to 800 Hz.

6. The electrospray ion source of claim 1, wherein a frequency of said pulse wave ranges from 50 to 300 Hz.

7. The electrospray ion source of claim 1, wherein said analyte solution parameter is a double layer relaxation time of a solvent in an analyte solution, and said power supply assigns said relaxation duration based on said double layer relaxation time.

8. The electrospray ion source of claim 7, wherein said processor assigns said relaxation duration, such that said relaxation duration is greater than or equal to said double layer relaxation time.

9. The electrospray ion source of claim 1, wherein said relaxation voltage is approximately 0 volts.

10. The electrospray ion source of claim 1, wherein said relaxation voltage is of the same polarity as said energized voltage.

11. The electrospray ion source of claim 1, further comprising a secondary working electrode, having a secondary liquid contacting surface in liquid communication with said liquid conduit, said power system for supplying voltage to said secondary working electrode in the form of a second pulse wave, said second pulse wave oscillating between at least an second energized voltage and a second relaxation voltage, wherein a duration of said second relaxation voltage ranges from 1 millisecond to 35 milliseconds.

12. The electrospray ion source of claim 1, wherein said electrospray ion source further comprises a sensor in electrical communication with said power system, said sensor for detecting a parameter related to an electric potential experienced by an analyte conveyed through said emitter.

13. The electrospray ion source of claim 12, wherein said parameter is selected from the group consisting of surface potential of said working electrode, electrical potential of a double layer proximate said working electrode, electrical potential outside of said double layer, and combinations thereof.

14. A method of ionizing an analyte of interest, comprising:

conveying an analyte solution comprising an analyte of interest through an electrospray ion source, said electrospray ion source having a working electrode with a liquid contacting surface in contact with said analyte solution; and supplying voltage in the form of a pulse wave to said working electrode, wherein said pulse wave oscillates between at least an energized voltage and a relaxation voltage, wherein a relaxation duration of said relaxation voltage ranges from 1 millisecond to 35 milliseconds and a frequency of said pulse wave ranges from 30-800 Hz.

15. The method of claim 14, wherein a continuous Taylor cone is emitted from said electrospray ion source while said voltage in the form of a pulse wave is supplied.

16. The method of claim 14, further comprising:

inputting an analyte solution parameter to a power supply associated with said electrospray ion source, and assigning a parameter of said pulse wave based on said analyte solution parameter.

17. The method of claim 16, wherein said analyte solution parameter is a double layer relaxation time, and said assigning step, comprises, assigning said relaxation duration such that said relaxation duration is greater than or equal to said double layer relaxation time.

18. The method of claim 14, wherein said relaxation voltage is approximately 0 volts.

19. The method of claim 14, further comprising:

detecting an analyte solution value related to an electric potential experienced by an analyte conveyed through said emitter, and adjusting a parameter of said pulse wave based on said analyte solution value.

* * * * *